United States Patent [19]

Malagari, Jr. et al.

[11] 4,244,757

[45] Jan. 13, 1981

[54] PROCESSING FOR CUBE-ON-EDGE ORIENTED SILICON STEEL

[75] Inventors: Frank A. Malagari, Jr., Freeport; Richard P. Schrecongost, Natrona Heights, both of Pa.

[73] Assignee: Allegheny Ludlum Steel Corporation, Pittsburgh, Pa.

[21] Appl. No.: 41,138

[22] Filed: May 21, 1979

[51] Int. Cl.[3] ..... H01F 1/04

[52] U.S. Cl. ..... 148/111; 148/112; 148/31.5

[58] Field of Search ..... 148/112, 113, 111, 31.5

[56] References Cited

U.S. PATENT DOCUMENTS

| | | | |
|---|---|---|---|
| 2,412,041 | 12/1946 | Gifford et al. | 148/110 |
| 3,905,842 | 9/1975 | Grenoble | 148/111 |
| 3,905,843 | 9/1975 | Fiedler | 148/111 |
| 3,957,546 | 5/1976 | Fiedler | 148/111 |
| 4,000,015 | 12/1976 | Malagari | 148/112 |
| 4,054,470 | 10/1977 | Malagari | 148/111 |
| 4,054,471 | 10/1977 | Datta | 148/112 |
| 4,078,952 | 3/1978 | Malagari | 148/111 |
| 4,102,713 | 7/1978 | Shilling et al. | 148/113 |
| 4,113,529 | 9/1978 | Fiedler et al. | 148/111 |
| 4,115,161 | 9/1978 | Datta | 148/111 |
| 4,123,299 | 10/1978 | Fiedler et al. | 148/111 |

*Primary Examiner*—L. Dewayne Rutledge
*Assistant Examiner*—John P. Sheehan
*Attorney, Agent, or Firm*—Vincent G. Gioia; William J. O'Rourke, Jr.

[57] ABSTRACT

A process for producing electromagnetic silicon steel having a cube-on-edge orientation. The process includes the steps of: preparing a melt of silicon steel containing from 0.02 to 0.06% carbon, from 0.015 to 0.15% manganese, from 0.0006 to 0.0080% boron, up to 0.0045% nitrogen, from 0.005 to 0.019% sulfur, no more than 0.0065% phosphorus and from 2.5 to 4.0% silicon; casting the steel; hot rolling the steel; welding the steel to another steel member of like chemistry; cold rolling the steel to a thickness no greater than 0.020 inch; decarburizing the steel; applying a refractory oxide coating to the steel; and final texture annealing the steel.

10 Claims, No Drawings

PROCESSING FOR CUBE-ON-EDGE ORIENTED SILICON STEEL

The present invention relates to an improvement in the manufacture of grain oriented silicon steel.

A number of patents describing boron-inhibited grain oriented silicon steel, and precessing therefor, have issued during the last few years. These patents include U.S. Pat. Nos. 3,905,842, 3,905,843, 3,957,546, 4,000,015, 4,054,470, 4,078,952, 4,102,713, 4,113,529, 4,115,161 and 4,123,299.

Through the present invention, there is provided a process for improving the magnetic properties of boron-inhibited grain oriented silicon steel as well as the weldability of the steel being processed thereto. Nitrogen, sulfur and phosphorus are controlled within specific ranges and processing as set forth herein. Ranges and processing are dissimilar from that disclosed in the heretofore referred to patents.

It is accordingly an object of the present invention to provide an improvement in the manufacture of electromagnetic silicon steel having a cube-on-edgeorientation.

In accordance with the present invention, a melt of silicon steel containing, by weight, from 0.02 to 0.06% carbon, from 0.015 to 0.15% manganese, from 0.0006 to 0.0080% boron, up to 0.0045% nitrogen, from 0.005 to 0.019% sulfur, no more than 0.0065% phosphorus and from 2.5 to 4.0% silicon is subjected to the conventional steps of casting, hot rolling, one or more cold rollings to a thickness no greater than 0.020 inch, decarburizing, application of a refractory oxide coating and final texture annealing. Also includable within the process is a hot rolled band heat treatment. Although cold rolling passes may be separated by an intermediate anneal, the preferred practice is to cold roll the steel to final gage without such an anneal, from a hot rolled band having a thickness of from 0.050 to about 0.120 inch. Melts consisting essentially of, by weight, 0.02 to 0.06% carbon, 0.015 to 0.15% manganese, 0.0006 to 0.0080% boron, up to 0.0045% nitrogen, 0.005 to 0.0019% sulfur, no more than 0.0065% phosphorus, 2.5 to 4.0% silicon, up to 1.0% copper, up to 0.1% tin, no more than 0.009% aluminum, balance iron, have proven to be particularly beneficial within the subject invention. Boron levels are usually in excess of 0.0008%. The refractory oxide coating usually contains at least 50% MgO. Steel produced in accordance with the present invention is characterized by a permeability of at least 1870 ($G/O_e$) at 10 oersteds and a core loss of no more than 0.700 watts per pound at 17 kilogauss—60 Hz. Permeabilities in excess of 1890 ($G/O_e$) at 10 oersteds and core losses of less than 0.680 watts per pound at 17 kilogauss—60 Hz, are well within the present invention.

Nitrogen and phosphorus are maintained within the respective ranges of up to 0.0045% and no more than 0.0065%, as both of these elements have been found to adversely affect the weldability of the steel. The weldability of steel with less than 0.0065% phosphorus has been found to be superior to steel having more than 0.0065% phosphorus, as is the case with steel having less than 0.0045% nitrogen versus steel having more than 0.0045% nitrogen. Phosphorus is preferably controlled at no more than 0.0060%. Nitrogen is preferably controlled so as not to exceed 0.0040%. Welding is an important operation within the process of the subject invention as it facilitates processing, increases yield and cuts costs. Although it is preferable to weld hot rolled bands prior to further processing, welding can occur at other stages of production. The present invention is not dependent upon any particular type of welding. Various forms of welding, including submerged arc, resistance and electron beam, may be used.

An additional reason for controlling nitrogen, and for controlling sulfur, is improved magnetic properties. Steel produced from melts having less than 0.0045% nitrogen is characterized by better magnetic properties than steel produced from melts having more than 0.0045%. Data taken from hot rolled bands attributes a similar affect to sulfur. For this reason sulfur is controlled within a range of from 0.005% to 0.019%.

The following examples are illustrative of several aspects of the invention.

EXAMPLE I.

Hot rolled bands of silicon steel were submerged arc welded to other bands of like chemistry, and cold rolled in accordance with conventional silicon steel processing. All of the bands were prepared from melts having carbon, manganese, sulfur, boron, nitrogen and silicon ranges within the broad ranges of the prior art patents referred to hereinabove. Some of the bands were prepared from melts having a chemistry within that of the subject invention.

The weld survival rate of the cold rolled bands was investigated as a function of melt phosphorus. The results are reported hereinbelow in Table I.

TABLE I

| % Phosphorus | % Weld Survival |
|---|---|
| 0.0060 or less | 65.2 |
| 0.0065 or less | 60.3 |
| 0.0070 or less | 41.4 |
| 0.0100 or less | 26.0 |

Note that the weld survival rate increased with decreasing phosphorus content, in accordance with the teachings of the subject invention. Only 26.0 and 41.4% of the welds of the bands with respective melt phosphorus contents of 0.0100% or less and 0.0070% or less survived, whereas 65.2 and 60.3% of the welds of the bands with respective melt phosphorus contents of 0.0060% or less and 0.0065% or less survived. Also note Table II hereinbelow, which shows that only 14.6% of the welds of the bands with melt phosphorus contents between 0.0065 and 0.0070% survived, whereas 59.5% of the welds of the bands with melt phosphorus contents between 0.0060 and 0.0065% survived.

TABLE II

| % Phosphorus | % Weld Survival |
|---|---|
| 0.0060–0.0065 | 59.5 |
| 0.0065–0.0070 | 14.6 |

EXAMPLE II.

The weld survival rate of the cold rolled bands of Example I was investigated as a function of both melt phosphorus and melt nitrogen. The results are reported hereinbelow in Table III.

TABLE III

| % Phosphorus | % Nitrogen | % Weld Survival |
|---|---|---|
| 0.0065 or less | 0.0045 or less | 65.8 |
| 0.0065 or less | 0.0040 or less | 80.0 |

TABLE III-continued

| % Phosphorus | % Nitrogen | % Weld Survival |
|---|---|---|
| 0.0060 or less | 0.0045 or less | 68.9 |
| 0.0060 or less | 0.0040 or less | 80.0 |

Note that the weld survival rate increased with decreasing nitrogen content, in accordance with the teachings of the subject invention. A higher percentage of welds survived for bands with both low phosphorus and nitrogen, than for bands with just low phosphorus. For example 65.8 and 68.9% of the welds survived for bands with respective phosphorus contents of 0.0065% or less and 0.0060% or less and nitrogen contents of 0.0045% or less, as contrasted to survival rates of 60.3 and 65.2% (Table I) for heats in which the nitrogen contents were up to about 0.0065%. With nitrogen contents below 0.0040%, the survival rates for phosphorus contents of 0.0065% or less and 0.0060% or less was 80%.

Table IV, hereinbelow, also shows that weld survival rates increase with decreasing nitrogen contents. Note that only 46.7% of the welds of the bands having melt phosphorus contents below 0.0065% and melt nitrogen contents between 0.0045 and 0.0055% survived, whereas 59.4% of the welds of the bands having melt phosphorus contents below 0.0065% and melt nitrogen contents between 0.0035 and 0.0045% survived.

TABLE IV

| % Phosphorus | % Nitrogen | Weld Survival |
|---|---|---|
| 0.0065 or less | 0.0035–0.0045 | 59.4 |
| 0.0065 or less | 0.0045–0.0055 | 46.7 |

EXAMPLE III.

A number of heats of silicon steel were cast and processed into silicon steel having a cube-on-edge orientation. Processing for the heats involved soaking at an elevated temperature for several hours, hot rolling to a nominal gage of 0.080 inch, hot roll band normalizing, cold rolling to a final gage of approximately 12 mils, heat treating at a temperature of 1475° F., coating with a refractory oxide base coating and final texture annealing at a maximum temperature of 2150° F. in hydrogen.

Each heat was classified as being of A or B quality, depending upon core loss. Heats of A quality were those wherein at least 50% of the coils had a core loss equal to or less than 0.704 watts per pound at 17 kilogauss—60 Hz. B quality heats were those wherein at least 50% of the coils had a core loss of greater than 0.704.

An analysis (core loss vs. coil end band sulfur) of the heats (11 heats both ends, 3 heats one end) was made. The results appear hereinbelow in Table V.

TABLE V

| | | Coil End Sulfur in % (No.) | | | | | | | |
|---|---|---|---|---|---|---|---|---|---|
| Quality | No. | 0.017 | 0.018 | 0.019 | 0.020 | 0.021 | 0.022 | 0.023 | 0.024 |
| A | 16 | 3 | 4 | 5 | 1 | 3 | 0 | 0 | 0 |
| B | 9 | 0 | 0 | 0 | 5 | 2 | 1 | 0 | 1 |

The advantage of controlling sulfur levels is readily evident from Table V. All heat ends (12) having a sulfur level at or below 0.019 were of A quality, i.e., a core loss equal to or less than 0.704 watts per pound at 17 kilogauss—60 Hz. On the other hand, 9 out of 13 coil ends having a sulfur level in excess of 0.019 were of B quality.

EXAMPLE IV.

A number of heats of silicon steel were cast and processed into silicon steel having a cube-on-edge orientation. Processing for the heats involved soaking at an elevated temperature for several hours, hot rolling to a nominal gage of 0.080 inch, hot roll band normalizing, cold rolling to a final gage of approximately 12 mils, heat treating at a temperature of 1475° F., coating with a refractory oxide base coating and final texture annealing at a maximum temperature of 2150° F. in hydrogen.

Coils from each heat were classified as to core loss. Seven classifications, less than or equal to 0.634, 0.664, 0.704, 0.744, 0.764 and 0.834, and greater than or equal to 0.835, were set up. Core loss measurements were in watts per pound at 17 kilogauss—60 Hz.

An analysis (core loss vs. melt nitrogen) of the coils (a total of 157) was made. The results appear hereinbelow in Table VI.

TABLE VI

| | | Core Loss WPP @ 17KG (%) | | | | | | |
|---|---|---|---|---|---|---|---|---|
| $N_2$(%) | No. | ≦0.634 | ≦0.664 | ≦0.704 | ≦0.744 | ≦0.764 | ≦0.834 | ≧0.835 |
| ≦0.0045 | 109 | 2 | 6 | 39 | 28 | 8 | 8 | 9 |
| ≧0.0046 | 48 | 0 | 0 | 10 | 17 | 17 | 33 | 23 |

The advantage of controlling nitrogen levels is readily evident from Table VI. Eight percent of the coils having a melt nitrogen at or below 0.0045% had a core loss equal to or less than 0.664 and 47% had a core loss equal to or less than 0.704. On the other hand, only 10% of the coils having a melt nitrogen at or above 0.0046% had a core loss equal to or less than 0.704 and 0% had a core loss equal to or less than 0.664.

EXAMPLE V.

Three heats (Heats A, B and C) of silicon steel were cast and processed into silicon steel having a cube-on-edge orientation. The chemistry of the heats appears hereinbelow in Table VII.

TABLE VII

| | Composition (wt. %) | | | | | | | | | | |
|---|---|---|---|---|---|---|---|---|---|---|---|
| Heat | C | Mn | S | B | N | Si | Cu | Al | P | Sn | Fe |
| A. | 0.03 | 0.035 | 0.016 | 0.0010 | 0.0037 | 3.15 | 0.35 | 0.003 | 0.005 | 0.039 | Bal. |
| B. | 0.031 | 0.036 | 0.015 | 0.0013 | 0.0038 | 3.09 | 0.34 | 0.003 | 0.006 | 0.039 | Bal. |
| C. | 0.039 | 0.035 | 0.016 | 0.0011 | 0.0034 | 3.17 | 0.35 | 0.003 | 0.005 | 0.041 | Bal. |

Processing for the heats involved soaking at an elevated temperature for several hours, hot rolling to a nominal gage of 0.080 inch, hot roll band normalizing, welding of hot rolled bands, hot rolled band normalizing, cold rolling to a final gage of approximately 11 mils, heat treating at a temperature of 1475° F., coating with a refractory oxide base coating and final texture annealing at a maximum temperature of 2150° F. in hydrogen.

All of the welds for the heats survived through cold rolling. The heats all had a phosphorus level below 0.0065% and a nitrogen level below 0.0045%.

The average magnetic properties (core loss and permeability) for the heats is set forth hereinbelow in Table VIII.

TABLE VIII

| Heat | Core Loss (WPP at 17KG) | Permeability (at $100_e$) |
|---|---|---|
| A. | 0.658 | 1912 |
| B. | 0.658 | 1905 |
| C. | 0.666 | 1898 |

From Table VIII it is evident that the steel of the present invention has excellent magnetic properties.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A process for producing electromagnetic silicon steel having a cube-on-edge orientation, which comprises the steps of: preparing a melt of silicon steel containing, by weight, from 0.02 to 0.06% carbon, from 0.015 to 0.15% manganese, from 0.0006 to 0.0080% boron, up to 0.0045% nitrogen, from 0.005 to 0.019% sulfur, no more than 0.0065% phosphorus and from 2.5 to 4.0% silicon; casting said steel; hot rolling said steel; welding said steel to another steel member of like chemistry; cold rolling said steel to a thickness no greater than 0.020 inch; decarburizing said steel; applying a refractory oxide coating to said steel; and final texture annealing said steel; said steel having a permeability of at least 1870($G/O_e$) at 10 oersteds and a core loss of no more than 0.700 watts per pound at 17 kilogauss—60 Hz.

2. A process according to claim 1, wherein said melt has at least 0.0008% boron.

3. A process according to claim 2, wherein the nitrogen content of said melt does not exceed 0.0040%.

4. A process according to claim 2, wherein said melt has no more than 0.0060% phosphorus.

5. A process according to claim 4, wherein the nitrogen content of said melt does not exceed 0.0040%.

6. A process according to claim 2, wherein a hot rolled band of said steel is welded to another hot rolled band.

7. A process according to claim 1, wherein said melt consists essentially of, by weight, 0.02 to 0.06% carbon, 0.015 to 0.15% manganese, 0.0006 to 0.0080% boron, up to 0.0045% nitrogen, 0.005 to 0.0019% sulfur, no more than 0.0065% phosphorus, 2.5 to 4.0% silicon, up to 1.0% copper, up to 0.1% tin, no more than 0.009% aluminum, balance iron.

8. A process according to claim 7, wherein said melt has at least 0.0008% boron.

9. A process according to claim 8, wherein the nitrogen content of said melt does not exceed 0.0040% and wherein said melt has no more than 0.0060% phosphorus.

10. A cube-on-edge oriented silicon steel made in accordance with the process of claim 2.

* * * * *